US005883612A

United States Patent [19]

Kreitzer

[11] Patent Number: 5,883,612

[45] Date of Patent: Mar. 16, 1999

[54] METHOD FOR POSITIONING A VIBRATING ALERT ADJACENT TO A SELECTED ALERT IN SELECTIVE CALL DEVICE

[75] Inventor: Stuart S. Kreitzer, Coral Springs, Fla.

[73] Assignee: Motorola, Inc., Schaumburg, Ill.

[21] Appl. No.: 740,048

[22] Filed: Oct. 24, 1996

[51] Int. Cl.[6] ..... G09G 5/00

[52] U.S. Cl. ..... 345/115; 345/117; 345/145; 345/146; 340/825.44

[58] Field of Search ..... 345/115, 117, 345/145, 146, 348–351; 340/825.44, 825.46, 825.36; 455/38.2, 38.4, 31.1, 31.2

[56] References Cited

U.S. PATENT DOCUMENTS 4,755,816 7/1988 DeLuca ..... 340/825.44

5,396,264 3/1995 Falcone et al. ..... 345/146

*Primary Examiner*—Steven J. Saras
*Assistant Examiner*—Seth D. Vail
*Attorney, Agent, or Firm*—Keith A. Chanroo

[57] ABSTRACT

A selective call device (100) has a plurality of first alerts and a second alert and includes a decoder/controller (106) generating a plurality of icons associated with the plurality of first alerts and the second alert (116) and a switch for selecting an alert. The decoder/controller (106), in response to the switch (118), positions a second alert icon adjacent to a selected icon when the selected icon is not the second alert icon. A display (108) displays the second alert icon adjacent to the selected icon and the decoder/controller (106) regenerates the plurality of icons wherein the second alert icon is repositioned adjacent to a reselected alert icon.

10 Claims, 3 Drawing Sheets

METHOD FOR POSITIONING A VIBRATING ALERT ADJACENT TO A SELECTED ALERT IN SELECTIVE CALL DEVICE

FIELD OF THE INVENTION

This invention relates in general to selective call devices, and in particular to a selective call device and method for positioning a vibrating alert adjacent to a selected alert.

BACKGROUND OF THE INVENTION

In conventional selective call systems, when a selective call device, e.g., a selective call receiver or transceiver, is addressed and a message is delivered to the selective call receiver or transceiver, the selective call device alerts the user that the message is received. The prior art selective call devices usually have one audible alert and one tactile (or vibrating) alert. Therefore, when the user wants to select the vibrating alert, e.g., when the user is in a meeting, noisy environment, or other places where an audible alert may be disturbing or annoying to other persons, the user generally selects the vibrating alert over the audible alert.

However, the more modern selective call devices are provided with more than one audible alert, generally several. The audible alerts may includes different kinds of melody that is pleasing to the user. Accordingly, the users frequently prefer different audible alerts and therefore select a different alert from the list of audible alerts that has a melody most pleasing to each user's individual taste.

However, irrespective of the audible alert chosen by the user of the selective call device, when the user is in a meeting or such places where the audible alert may disturb other, the user wants to be able to quickly select the vibrating alert.

Therefore, what is needed is a selective call device that enables the user to easily and quickly select the vibrating alert irrespective of the current audible alert selection of the selective call device.

BRIEF SUMMARY OF THE INVENTION

In a selective call device having a plurality of first alerts and a second alert, a method and apparatus including the steps of generating a plurality of first alert icons associated with the plurality of first alerts and a second icon associated with the second alert wherein the plurality of first alerts are a plurality of audible alerts and the second alert is a vibrating alert, selecting a first alert icon from a plurality of icons, moving the second icon adjacent to a selected first alert icon, displaying the plurality of icons wherein the second icon is positioned adjacent to the selected first alert icon, and in response to the step of selecting another first alert icon, displaying the second icon repositioned adjacent to the other first alert icon being selected wherein the step of selecting enables a selection of the vibrating alert with a single scrolling stroke.

DESCRIPTION OF A PREFERRED EMBODIMENT

Figure 1:
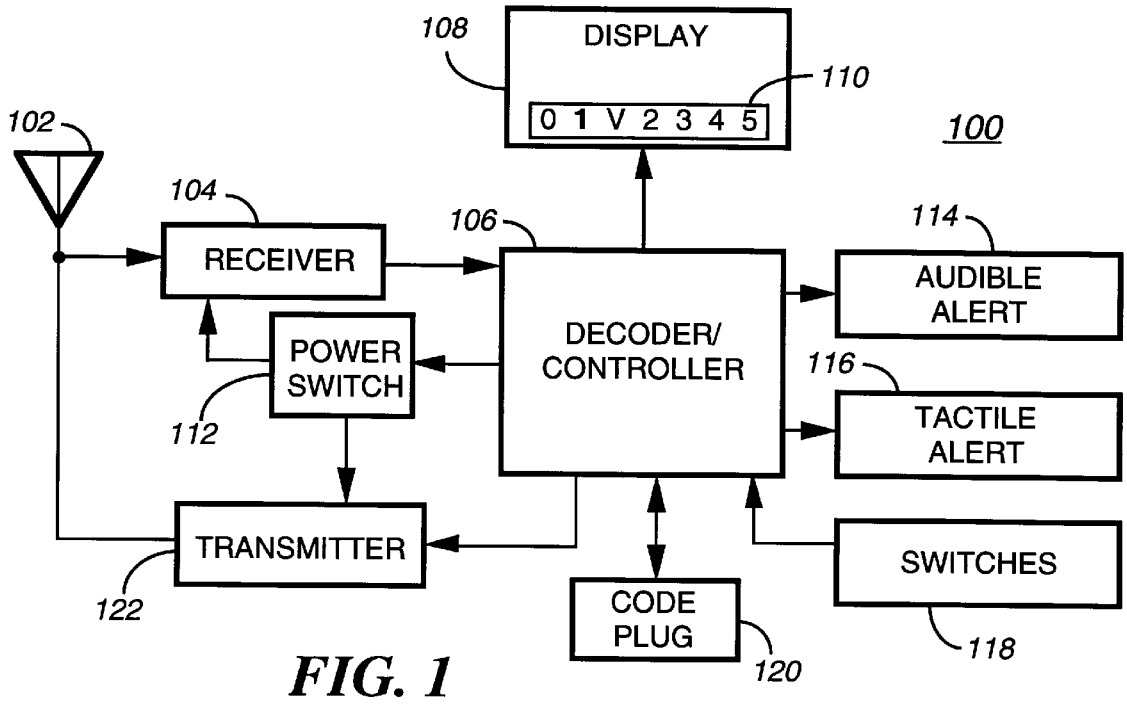
FIG. 1 is an electrical block diagram of a selective call device in accordance with the preferred embodiment of the present invention.

Referring to FIG. 1, an electrical block diagram of a selective call device, e.g., a selective call receiver or transceiver, is shown in accordance with the preferred embodiment of the present invention. The selective call device 100 comprises an antenna 102 for intercepting transmitted radio frequency (RF) signals which are coupled to the input of a receiver 104. The RF signals are preferably selective call message signals which provide, for example, a receiver address and an associated message, such as voice, numeric or alphanumeric messages. However, it will be appreciated that other well known selective call signaling formats, such as tone only signaling or tone signaling, would be suitable for use as well. The receiver 104 processes the RF signal and produces at the output a data stream representative of a demodulated data information. The demodulated data information is coupled into the input of a decoder/controller 106 which processes the information in a manner well known in the art. A transmitter 122 is coupled to the antenna 102 and the decoder/controller 106. A power switch 112, coupled to the decoder/controller 106, is used to control the supply of power to the receiver 104, thereby providing a battery saving function, and to the transmitter 122 for transmitting the messages in responses subsequent to the receipt of a selective call message.

For purposes of this illustration, it will be assumed that the FLEX™ signaling format is used although other signaling formats could be utilized as well. When the address is received by the decoder/controller 106, the received address is compared with one or more addresses stored in a code plug (memory) 120, and when a match is detected, an alert signal is generated to alert a user that a selective call message has been received. The alert signal can be directed to an audible alerting device 114 for generating an audible alert or to a tactile alerting device 116 for generating a silent vibrating alert. Switches 118 allow the user of the selective call device to, among other things, select between the audible alert 114 and the tactile alert 116 in a manner well known in the art. The preferred embodiment of the present invention comprises a plurality of audible alerts. The user can select any one of the plurality of audible alerts with the switches 118.

The message information which is subsequently received is stored in memory 204 (FIG. 2) and can be accessed by the user for display using one or more of the switches 118 which provide such additional functions as reset, read, and delete, etc. Specifically, by the use of appropriate functions provided by the switches 118, the stored message is recovered from memory and processed by the decoder/controller 106 for displaying by a display 108 which enables the user to view the message. The receipt of the message by the selective call device 100 can, e.g., automatically generate the ack-back response to a selective call base station to inform it that the message was successfully received. The user can also enter a message by using switches 118 or some other-input devices well known to one of ordinary skilled in the arts.

According to the preferred embodiment of the present invention, the decoder/controller 106 generates preferably a menu 110 that is displayed on the display 108. The menu 110 includes icons representing the plurality of first alerts preferably a plurality of audible alerts and a second alert preferably a tactile or vibrating alert. The plurality of audible alert icons and the vibrating alert icon are displayed in a predetermined sequence. For the purpose of illustration, the audible alerts are represents as numbers (1–5) and the vibrating alert is represented as the letter "V" in the menu 110. When user selects one of the audible alert, the selection is illustrated as, e.g., highlighted text or any other means for differentiating the selected icon from the unselected icons. As illustrated, the vibrating icon "V" is positioned next to or adjacent to the selected audible alert icon. It is understood that the vibrating icon can be positioned to the left or right of the selected audible alert icon in a menu 110 that is displayed horizontally. In a menu 110 that is displayed vertically, the vibrating icon can be position above or below the selected vibrating icon without departing from the scope or intent of this application.

Figure 2:
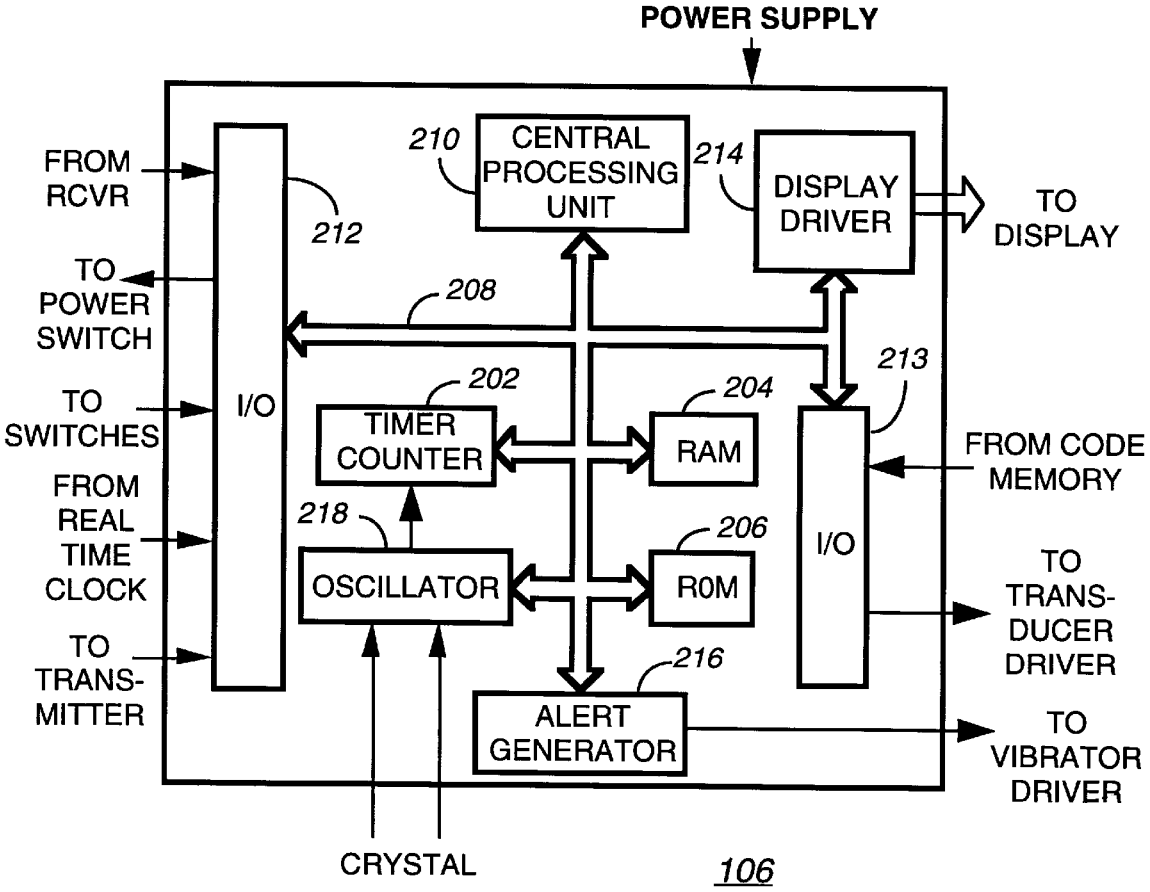
FIG. 2 is an electrical block diagram of a microcomputer based decoder/controller suitable for use in the selective call device of FIG. 1.

The decoder/controller 106 of FIG. 1 can be implemented utilizing a microcomputer as shown in FIG. 2. FIG. 2 is an electrical block diagram of a microcomputer based decoder/controller suitable for use in the selective call device of FIG. 1. As shown, the microcomputer 106 is preferably of the series microcomputers, such as manufactured by Motorola, Inc., which includes an on-board display driver 214. The on-board display driver 214 generates the menu 110 and the plurality of audible alerting icons (1–5) along with the vibrating icon. The microcomputer 106 includes an oscillator 218 which generates the timing signals utilized in the operation of the microcomputer 106. A crystal, or crystal oscillator (not shown) is coupled to the inputs of the oscillator 218 to provide a reference signal for establishing the microcomputer timing. A timer/counter 202 couples to the oscillator 218 and provides programmable timing functions which are utilized in controlling the operation of the receiver or the processor. A RAM (random access memory) 204 is utilized to store variables derived during processing, as well as to provide storage of message information which are received during operation as a selective call device. A ROM (read only memory) 206 stores the subroutines which control the operation of the selective call device or the processor which will be discussed further. It will be appreciated that in many microcomputer implementations, the programmable-ROM (PROM) memory area can be provided either by a programmable read only memory (PROM) or an EEPROM (electrically erasable programmable read only memory). The oscillator 218, timer/counter 202, RAM 204, and ROM 206 are coupled through an address/data/control bus 208 to a central processing unit (CPU) 210 which performs the instructions and controls the operations of the microcomputer 106.

The demodulated data generated by the receiver is coupled into the microcomputer 106 through an input/output (I/O) port 212. The demodulated data is processed by the CPU 210, and when the received address is the same as stored within the code-plug memory which couples into the microcomputer through, for example an I/O port 213, the message, if any, is received and stored in RAM 204. Recovery of the stored message, and selection of the predetermined destination address, is provided by the switches which are coupled to the I/O port 212. The microcomputer 106 then recovers the stored message and directs the information over the data bus 208 to the display driver 214 which processes the information and formats the information for presentation by a display 108 (FIG. 1) such as an LCD (liquid crystal display). At the time a selective call device's address is received, an alert signal is generated corresponding to the user selected alert which is routed through the data bus 208 to an alert generator 216 that generates the alert enable signal which is coupled to the audible alert device that was described above.

Alternatively, when the vibrator alert is selected, as described above, the microcomputer generates an alert enable signal which is coupled through data bus 208 to the I/O port 212 to enable generation of a vibratory, or silent alert. Switch inputs are received by the I/O port 212 via the data bus 208. The switch inputs are processed by the CPU 210. Specifically, the display driver 214, e.g., highlights or emphasizes the vibrating alert "V" in the menu 110 to illustrate that it has been selected and de-emphasizes the previously selected audible alert.

The battery saver operation is controlled by the CPU 210 with battery saving signals which are directed over the data bus 208 to the I/O port 212 which couples to the power switch 112. Power is periodically supplied to the receiver to enable decoding of the received selective call device address signals and any message information which is directed to the selective call device. Specifically, when the selective call device 100 begins decoding the selective call signal, the receiver is powered by the power switch. When the selective call message is received and stored, the microcomputer 106 sends a signal to the power switch 112 to disable power to the receiver 104 and enable power to the transmitter for transmitting ack-back signals.

Figure 3:
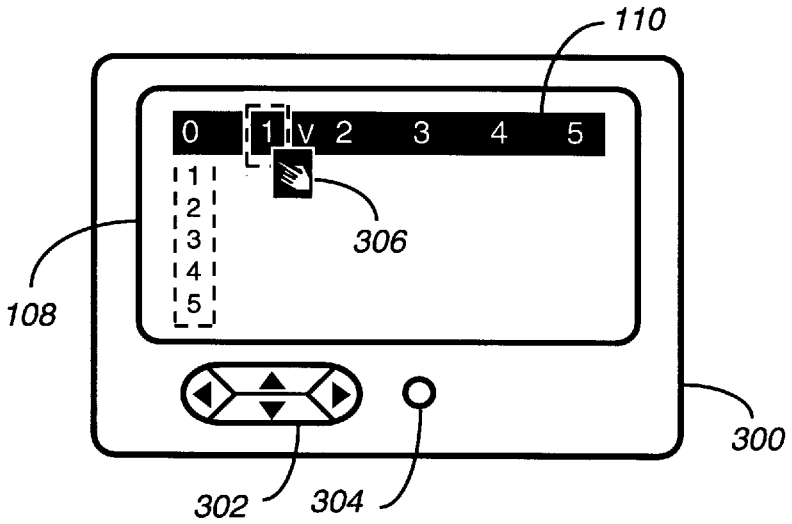
FIGS. 3–4 are block diagrams of a display of the selective call device showing the alert settings in accordance with the preferred embodiment of the present invention.
Figure 4:
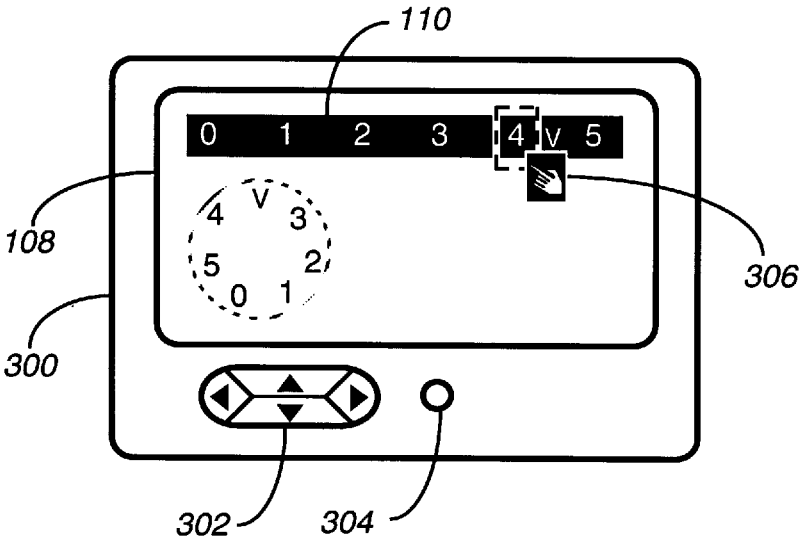

Referring to FIGS. 3–4, more detailed block diagrams of the display are shown according to FIG. 1. FIG. 3 in particular shows the outer housing 300 of the selective call device. The housing 300 shows the display 108 and the switches 118. The switches 118 comprises a directional switch 302 which causes a cursor 306 to scroll across the plurality of icons and a second switch 304 for selecting the icon indicated by the cursor 306. The scrolling is accomplished by the movement of the cursor 306 and when the cursor is over or on the desired icon, the user presses the second switch 304 to select a new alert. The display 108 shows the plurality of first alerts preferably a plurality of alert icons 1–5 and the second alert icon preferably a vibrating alert icon "V" horizontally. The emphasized icon 1 is the selected icon which is adjacent to the vibrating alert icon "V". It is understood by one of ordinary skill in the art that the menu 110 can be displayed vertically or even in a circular orientation (shown with phantom lines) without departing from the scope and intent of the present application.

FIG. 4 illustrates the display 108 similar to FIG. 3 except that a new alert icon 4 is selected and the alert icon 1 is de-emphasized. As shown, the directional switch 302 with the second switch 304 are used to select the alerting icon 4 with the cursor 306 which is scrolled to the desired icon. After the selection, and according to the preferred embodiment of the present invention, the vibrating alert icon "V" is positioned and displayed adjacent to the emphasized selected icon 4. It is understood by one of ordinary skilled in the art that instead of position the vibrating alert icon adjacent (next) to the selected icon, the selected icon could be positioned adjacent to the vibrating alert icon. Therefore, the selected icon 4 would be moved instead of the vibrating icon "V".

Figure 5:
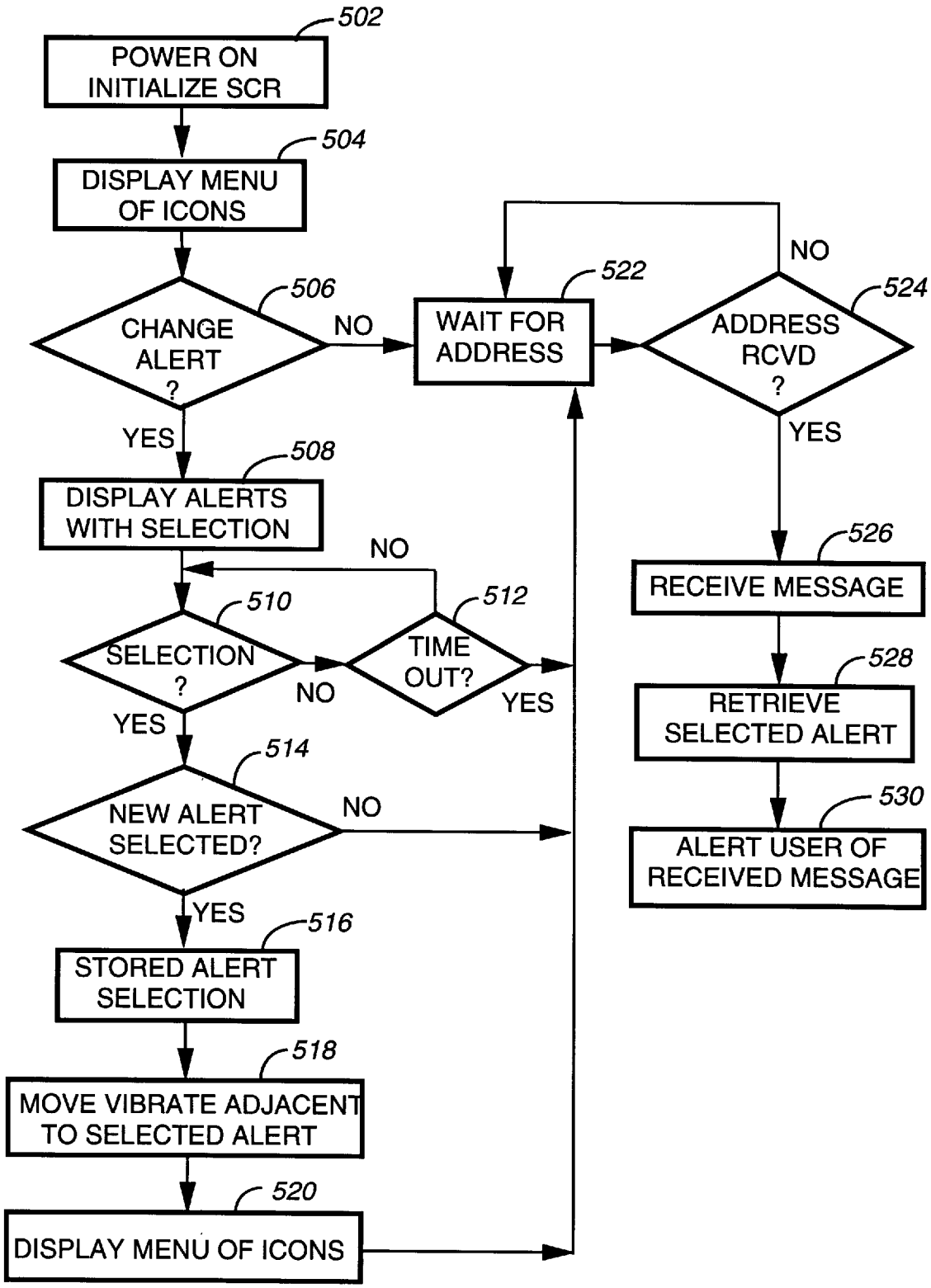
FIG. 5 is a flow diagram illustrating the operation of the selective call device in accordance with the preferred embodiment of the present invention.

Referring to FIG. 5, a flow diagram of the selective call device is shown in accordance with the preferred embodiment of the present invention. Operationally, when the selective call device is turned-on (powered-up) and the initialization of the selective call device is completed, step 502, the decoder/controller, e.g., the display driver 214, displays the menu with the plurality of audible alert icons including the vibrating alert icon, step 504. The switches 118 are used to select one of the icons. The menu 110 shows the selected alert icon emphasized or highlighted and the vibrating alert icon "V" positioned adjacent to the selected icon.

Step 506 determines if the user is attempting to change the selected icon, and if so, the display driver displays the menu with the cursor 306 moving to different icon, step 508. When the user has scrolled to the icon he desires to select, he uses the second switch to confirm his selection, step 510. If no selection was made and a time-out period has not expired, step 512, the decoder/controller continues to wait for the user's selection, step 510. When the user uses the directional switch 302 to change the selected icon (move the cursor 306), step 510, and when the user presses the second switch to confirm his selection, step 514, the new selection (or reselected icon) is stored, step 516. In step 518, in the preferred embodiment, the vibrating alert icon "V" is positioned (moved) adjacent to the reselected alert icon 4. In an alternative embodiment, the selected icon 4 is positioned (moved) adjacent to the vibrating alert icon "V". The menu is refreshed (displayed) with the selected or reselected icon emphasized, e.g., highlighted, and adjacent of the vibrating alert icon, step 520.

If steps 506 and 514 are no and step 512 is yes, the decoder/controller waits for the address, step 522. If no address is received step 524, the decoder/controller continues to search for its address until it is time to battery save. However, when the address is received, step 524, the decoder/controller receives the message, step 526, retrieves the selected audible alert (or other alert), step 528, and alerts the user of the received message, step 530.

In this way, when the user selects another alert, e.g., an audible alert, the vibrating and the selected alert icons are positioned adjacent to each other. The user is able to reselect the vibrating icon with a minimum number of key-stroke, e.g., one or a single scrolling stroke and one select key stroke. The user therefore does not need to look at the screen or display because the vibrating alert icon is always placed in same position, e.g., to the left, or above the selected alert icon or the reselected alert icon. Furthermore, when the vibrating alert icon is selected, the audible alert icon does not change position, and therefore, the user uses the same number of key strokes, only scrolling in the opposite direction to reselect his preferred or favorite audible alert.

A selective call device has a plurality of audible alerts and a vibrating alert and comprises a decoder/controller that generates a menu of icons associated with the plurality of audible alerts and the vibrating alert and a switch selects and reselects an alert from the menu of icons. The decoder/controller, in response to the switch, positions a vibrating alert icon adjacent to a selected icon when said selected icon is an audible alert icon. A display displays the menu of icons emphasizing the selected icon wherein the vibrating alert icon is positioned adjacent to the selected icon. The decoder/controller generates the menu of icons in response to a reselected icon causing the display to display the menu of icons emphasizing the reselected audible alert icon wherein the vibrating alert icon is repositioned adjacent to the reselected audible alert icon.

What is claimed is:

1. In a selective call device having a plurality of first alerts and a second alert, a method comprising the steps of:

generating a plurality of first alert icons associated with the plurality of first alerts and a second icon associated with the second alert wherein the plurality of first alerts are a plurality of audible alerts and the second alert is a vibrating alert;

selecting a first alert icon from a plurality of icons;

moving the second icon adjacent to a selected first alert icon;

displaying the plurality of icons wherein the second icon is positioned adjacent to the selected first alert icon; and in response to the step of selecting another first alert icon, displaying the second icon repositioned adjacent to the other first alert icon being selected wherein the step of selecting enables a selection of the vibrating alert with a single scrolling stroke.

2. The method according to claim 1 wherein the step of generating generates a menu displaying the plurality of icons.

3. The method according to claim 1 wherein the step of generating generates the plurality of icons in a predetermined sequence.

4. The method according to claim 1 wherein the step of displaying displays a selected alert icon repositioned adjacent to the second icon.

5. A selective call device having a plurality of first alerts and a second alert, comprising:

a decoder/controller generating a plurality of first icons associated with the plurality of first alerts and a second icon associated with the second alert wherein the plurality of first alerts are a plurality of audible alerts and the second alert is a vibrating alert;

a switch for selecting an alert;

the decoder/controller, in response to the switch, for positioning the second icon adjacent to a selected first icon;

a display for displaying the second icon adjacent to the selected first icon; and the decoder/controller regenerating a plurality of icons wherein the second icon is repositioned adjacent to a reselected first icon to enable the switch to select the vibrating alert with a single scrolling stroke.

6. The selective call device according to claim 5 wherein the display displays the plurality of icons as a menu.

7. The selective call device according to claim 5 wherein the decoder/controller emphasizes a selected icon.

8. The selective call device according to claim 5 wherein the decoder/controller positions the selected first icon adjacent to the second icon.

9. The selective call device according to claim 5 wherein the switch comprises a first switch for scrolling from one icon to another and a second switch for selecting a first icon indicated by the first switch.

10. A selective call device having a plurality of audible alerts and a vibrating alert, comprising:

a decoder/controller that generates a menu of icons including a plurality of first icons associated with the plurality of audible alerts and a vibrating alert icon associated with the vibrating alert;

a switch for selecting and reselecting an alert from the menu of icons;

the decoder/controller, in response to the switch, positions the vibrating alert icon adjacent to a selected first icon;

a display for displaying the menu of icons emphasizing the selected first icon wherein the vibrating alert icon is positioned adjacent to the selected first icon; and the decoder/controller generates the menu of icons in response to a reselected first icon causing the display to display the menu of icons emphasizing the reselected first icon wherein the vibrating alert icon is repositioned adjacent to the reselected first icon to enable the switch to select the vibrating alert with a single scrolling stroke.

* * * * *